US009038201B2

(12) United States Patent
Lee

(10) Patent No.: US 9,038,201 B2
(45) Date of Patent: May 26, 2015

(54) NON-SLIP FOOTWEAR

(76) Inventor: Mi Nam Lee, Gyeongsan-si (KR)

( * ) Notice: Subject to any disclaimer, the term of this patent is extended or adjusted under 35 U.S.C. 154(b) by 0 days.

(21) Appl. No.: 14/238,471

(22) PCT Filed: Aug. 16, 2012

(86) PCT No.: PCT/KR2012/006496

§ 371 (c)(1),
(2), (4) Date: Feb. 11, 2014

(87) PCT Pub. No.: WO2013/025049

PCT Pub. Date: Feb. 21, 2013

(65) Prior Publication Data

US 2014/0298569 A1 Oct. 9, 2014

(30) Foreign Application Priority Data

Aug. 18, 2011 (KR) ..... 20-2011-0007448

(51) Int. Cl.

| | |
|---|---|
| ***A41B 11/00*** | (2006.01) |
| ***A43B 5/08*** | (2006.01) |
| ***A61H 7/00*** | (2006.01) |
| ***A43B 13/22*** | (2006.01) |

(52) U.S. Cl.

CPC ..... *A41B 11/008* (2013.01); *A43B 5/08* (2013.01); *A61H 7/001* (2013.01); *A61H 7/007* (2013.01); *A61H 2201/1642* (2013.01); *A61H 2201/165* (2013.01); *A61H 2201/1695* (2013.01); *A43B 13/223* (2013.01)

(58) Field of Classification Search

CPC ..... A41B 11/00

USPC ..... 2/239, 241, 242, 161.3, 161.8; 36/92, 36/94, 24.5

See application file for complete search history.

(56) References Cited

U.S. PATENT DOCUMENTS

| | | | | |
|---|---|---|---|---|
| 5,867,838 | A * | 2/1999 | Corry | 2/239 |
| 6,138,281 | A * | 10/2000 | Chiaruttini | 2/239 |
| 6,385,779 | B2 * | 5/2002 | Boersema | 2/239 |
| 7,107,626 | B1 * | 9/2006 | Andrews | 2/239 |
| D548,951 | S * | 8/2007 | Paulin | D2/980 |

FOREIGN PATENT DOCUMENTS

| | | | |
|---|---|---|---|
| JP | 2002-212803 | A | 7/2002 |
| JP | 2004-011087 | A | 1/2004 |
| JP | 2006-081899 | A | 3/2006 |
| JP | 2008-202161 | A | 9/2008 |
| KR | 20-0321711 | Y1 | 7/2003 |

OTHER PUBLICATIONS

International Search Report for PCT/KR2012/006496 mailed from ISA/KR on Feb. 27, 2013.

* cited by examiner

*Primary Examiner* — Tejash Patel
(74) *Attorney, Agent, or Firm* — Revolution IP, PLLC

(57) ABSTRACT

Disclosed is a non-slip footwear which comprises a main body formed of a flexible material and formed to surround the sole of a foot of a user and to open the top side of the foot; toe insertion holes formed of the flexible material, protruding from the front part of the main body so that toes of the foot are respectively inserted into the toe insertion holes; an non-slip outsole formed at the heel part of the main body and formed of foamed rubber having abrasion resistance, and having a thickness of 1 mm~5 mm; and non-slip dots formed at the sole part of the main body and the non-slip outsole.

8 Claims, 2 Drawing Sheets

NON-SLIP FOOTWEAR

CROSS REFERENCE TO PRIOR APPLICATIONS

This application is a National Stage Application of PCT International Patent Application No. PCT/KR2012/006496 filed on Aug. 16, 2012, under 35 U.S.C. §371, which claims priority to Korean Patent Application No. 20-2011-0007448, filed on Aug. 18, 2011, which is hereby incorporated by reference in its entirety.

TECHNICAL FIELD

The present invention relates to non-slip footwear, and more particularly to non-slip footwear which prevents a user from slipping in water activity facilities, such as a swimming pool, or a bath, prevents foreign substances including keratinized tissues of feet of the user and Trichophyton mentagrophytes from being introduced into the bath so as to achieve hygienic water quality management, and is normally worn by the user even in a place, in which water is not used, so as to maintain foot health and to acquire both toe correction effects and fashionable effects.

BACKGROUND ART

In general, since users move while taking off shoes in a swimming pool or a public bath, tiles are installed on the floor surface so that the users do not feel discomfort during a moving process and a waterproof function is performed. When the tiles are wet, a user may slip on the tiles and, if the user slips on the tiles, the user may be bruised or break a bone due to the hard floor surface.

Therefore, a non-slip technique is generally applied to tiles. However, only such a non-slip technique may not sufficiently suppress slipping.

Thus, a user needs to walk cautiously so as not to slip in a swimming pool. If a user is accompanied by a child or an infant who is not well behaved, the child or the infant may wear non-slip socks provided with non-slip dots attached to the soles thereof, but if the non-slip socks are wet, a fiber absorbs water, and the water absorbed by the fiber is emitted to the outside during walking and thus, lowers wearing comfort. Further, since socks generally have a structure surrounding the entirety of feet from the toes to the heels, the child or the infant wearing the non-slip socks feels discomfort in moving of toes and thus frequently takes the non-slip socks off.

Accordingly, non-slip shoes worn by a user in a swimming pool have been developed now. For example, Korean Utility Model Registration No. 20-0321711 discloses non-slip socks-type shoes in which sucker-type recesses are formed on the lower surface of the sole of the shoe and a hole passing through the sole is formed at a designated position of each of the recesses.

However, since the above shoes have a closed toe part, come up to the ankles of a user, and are formed of rubber, silicon, or latex, the shoes have low air and water permeability except for a part of the shoe provided with through holes and thus cause inconvenience when a user wears the shoes. Further, it is unreasonable for the user to normally wear the shoes due to the external appearance of the shoes, and the shoes have excellent elasticity but have low flexibility, restrict movement of feet, and thus cause a burden in wearing.

During a general walking process, the heel part of the sole of a foot contacts the floor first. However, since general non-slip socks are provided non-slip protrusions formed at the front part rather than the heel part of the sock, even if a user wears the non-slip socks under a slippery environment, such as a swimming pool, the user may slip. Further, since the non-slip socks do not include a unit to absorb impact during a process of setting feet on a hard tile floor, load generated during the walking process may be transmitted to a human body.

Until now, footwear suitable for use in a swimming pool has not been developed.

Women today frequently wear narrow shoes, such as high-heeled shoes, and thus suffer from deformity, such as toe bending, and, if severe, hallux valgus. Hallux valgus is an abnormal bending or deviation of the big toe towards the other toes of the same foot and inward protruding of the joint of the big toe, and the protruding joint is stimulated and turns red during standing or walking and thus, calluses are formed on the joint, thereby causing inflammation and pain. Further, since the big toe does not play a part of supporting the body of a person and generating propulsive force, pain occurs on other parts of the foot and, if severe, deformity of the shape of the foot and waist pain is generated.

In order to correct such toe deformity, a recently used toe corrective insert is formed of a material having elasticity and is interposed between toes. However, since such a toe corrective insert does not include a fixing unit, a user wears the toe corrective inserts and then wears socks or stockings and thus does not use the toe corrective inserts in a swimming pool or the like. Moreover, since the toe corrective insert is not precisely located at a desired position and is twisted during wearing, the toe corrective insert lowers wearing comfort and exhibits poor correction effects.

DISCLOSURE

Technical Problem

Therefore, the present invention has been made in view of the above problems, and it is an object of the present invention to provide non-slip footwear in which toe insertion holes, into which toes of a foot of a user are respectively inserted, formed at the front part thereof and non-slip units are formed on the sole including the heel thereof, so as to completely prevent the user from slipping in a swimming pool or the like and thus to secure safety.

It is another object of the present invention to provide non-slip footwear which is provided with corrective inserts formed of silicon and attached to areas between toe insertion holes corresponding to areas between toes of a user so as to have a correction effect so that the toes maintain to their original shapes, and is formed of a flexible material not absorbing moisture so that the non-slip footwear repeats compression and expansion during walking and promotes circulation of blood in the foot to keep the user's foot health.

It is a further object of the present invention to provide non-slip footwear which covers the heel of a foot of a user so that the user may become confident in a swimming pool or the like even if the user is reluctant to walk barefoot due to keratinized tissues, and provides various colors and designs so as to acquire fashionable effects.

Technical Solution

In accordance with an aspect of the present invention, the above and other objects can be accomplished by the provision of non-slip footwear including a main body formed to surround the sole of a foot of a user and to open the top side of the foot, toe insertion holes protruding from the front part of the main body so that toes of the foot are respectively inserted into the toe insertion holes, an non-slip outsole formed at the heel part of the main body, and non-slip dots formed at the sole part of the main body.

The main body and the toe insertion holes of the non-slip footwear may be formed of a flexible material and, as such a material, a synthetic fiber or silicon not absorbing moisture may be used.

Toe corrective inserts may be attached to areas between the toes of the toe insertion holes so that the toes of the foot have their original shapes, and acupressure protrusions may protrude from the inner surface of the main body.

The front parts of the toe insertion holes may be opened so that the front parts of the toes protrude outward from the non-slip footwear and thus the toes freely move, and bending parts having elasticity may be formed at all the ends of the non-slip footwear so that keratinized tissues soaked in water are not introduced into a swimming pool so as to improve the quality of water and to eliminate visual and psychological unpleasantness of a third party.

Advantageous Effects

The non-slip footwear in accordance with the present invention having the above-described configuration includes the non-slip outsole provided at the heel part of the non-slip footwear first contacting the floor during walking and the non-slip dots provided on the sole of the non-slip footwear and thus, prevents a user from slipping in water activity facilities, such as a swimming pool, or a watery place, such as a bath, thereby allowing people of all ages and both sexes to safely exercise even in a watery place.

Further, the non-slip footwear is formed of a material not absorbing water so as to acquire excellent wearing comfort at the inside or the outside of a swimming pool, is closely attached to areas between toes of the foot of a user while surrounding the heel of the foot and thus prevents Trichophyton mentagrophytes and keratinized tissues from contaminating water in the swimming pool so as to keep the swimming pool clean, and shields keratinized tissues of the heel of the foot of the user so as to allow the user to conveniently use the swimming pool, to eliminate visual and psychological unpleasantness of a third party, and to provide fashionable effects.

Further, since the toe insertion holes into which the toes are respectively inserted are formed and parts of the toes are exposed to the outside so that the toes may freely move, the non-slip footwear is conveniently used in daily life as well as in a watery place. The toe corrective inserts provided between the toes have an effect of correcting the toes, and provide fashionable effects to people reluctant to use public facilities, such as a swimming pool, due to toe deformity or hallux valgus caused by wearing of shoes.

Further, since the non-slip footwear is formed of a material having high flexibility, the non-slip footwear compresses the foot when the foot is lifted and expands according to the shape of the sole of the foot when the foot contacts the floor, thus stimulating the foot. Moreover, the non-slip footwear exerts an acupressure effect through the acupressure protrusions and the toe corrections units and thus, promotes circulation of blood in the foot of the user, and absorbs impact, transmitted to the heel of the foot during walking, through the non-slip outsole of the heel part of the non-slip footwear and thus, prevents user inconvenience during walking.

DESCRIPTION OF DRAWINGS

The above and other objects, features and other advantages of the present invention will be more clearly understood from the following detailed description taken in conjunction with the accompanying drawings, in which.

MODE FOR INVENTION

Figure 1:
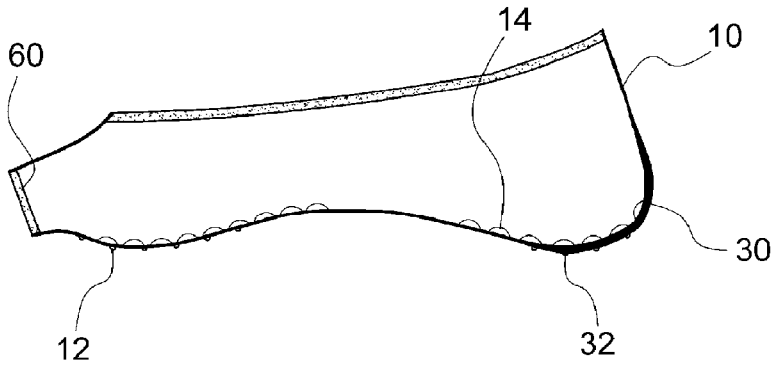
FIG. 1 is a side view illustrating non-slip footwear in accordance with the present invention.
Figure 2:
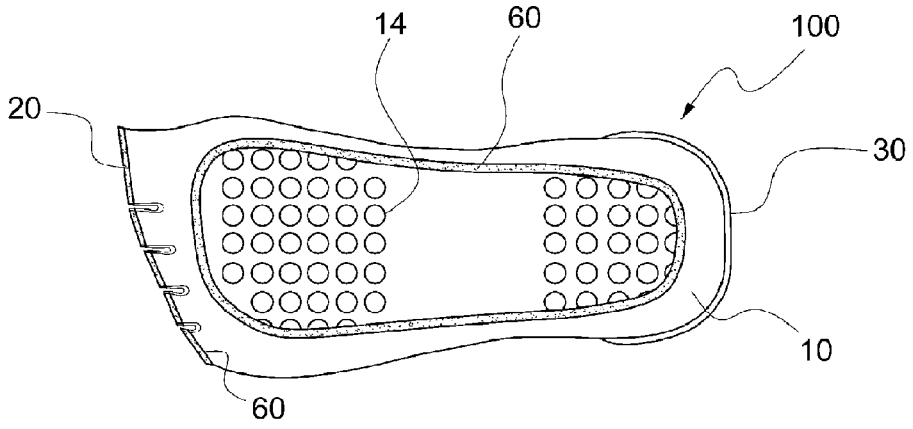
FIG. 2 is a top view of FIG. 1.
Figure 3:
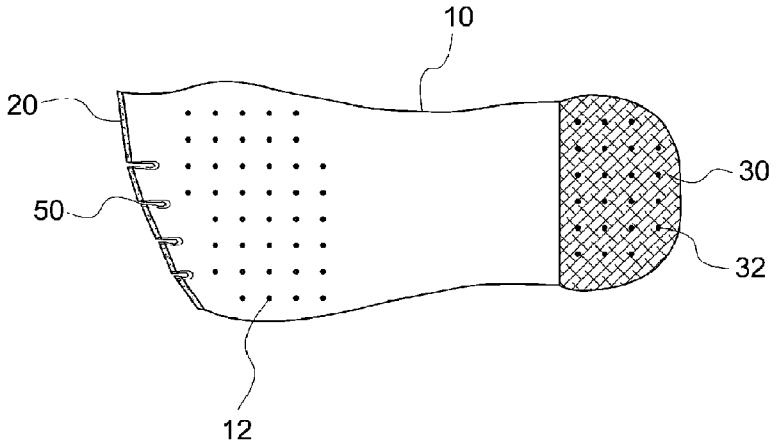
FIG. 3 is a bottom view of FIG. 1.
Figure 4:
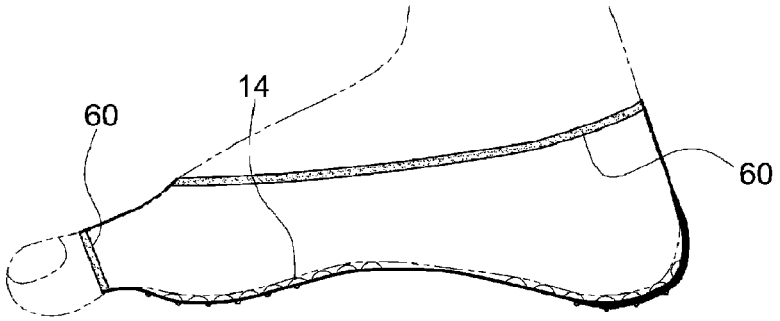
FIG. 4 is a side view of the non-slip footwear in accordance with the present invention in use.
Figure 5:
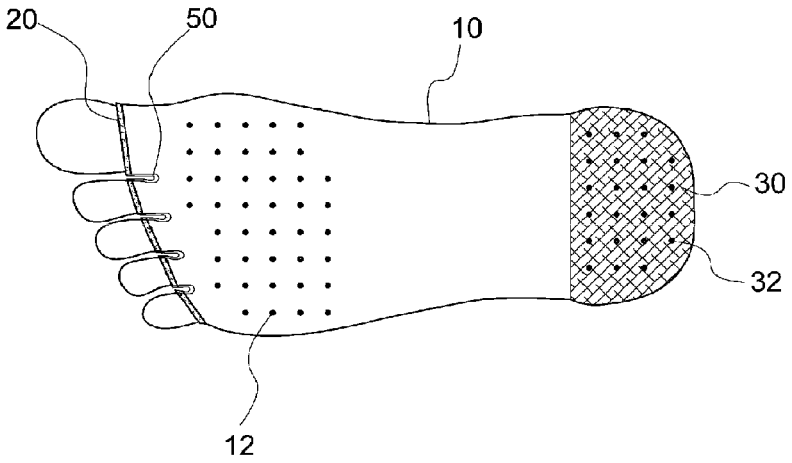
FIG. 5 is a bottom view of the non-slip footwear in accordance with the present invention in use.

Now, preferred embodiments in accordance with the present invention will be described in detail with reference to the annexed drawings.

Non-slip footwear in accordance with the present invention generally includes a main body 10 formed to surround the sole of a foot of a user and to open the top side of the foot, toe insertion holes 20 protruding from the front part of the main body 10 so that toes of the user are respectively inserted into the toe insertion holes 20, an non-slip outsole 30 formed at the heel part of the main body 10, and non-slip dots 12 and 32 formed at the sole part of the main body 10 and the non-slip outsole 30.

The main body 10 and the toe insertion holes 20 are formed of a synthetic fiber which does not absorb moisture. For example, as the synthetic fiber, polyester or polyurethane may be used. Since polyester does not dye effectively, polyurethane alone may be used or polyurethane and polyester may be mixed. In addition, other synthetic fibers may be used. Further, acupressure protrusions 14 may protrude from the inner surface of the main body 10.

The front parts of the toe insertion holes 20 are opened so that the front parts of the toes protrude outward from the non-slip footwear 100, and toe corrective inserts 50 having elasticity and shape stability, such as silicon, are further formed at areas between the toes of the toe insertion holes 20.

The non-slip outsole 30 is formed of foamed rubber having abrasion resistance so as to be strong to abrasion and prevent slipping, and has a thickness of about 1 mm~5 mm so as to absorb impact during walking.

Bending parts 60 having elasticity may be formed at the end of the top part of the main body 10 and the ends of the front parts of the toe insertion holes 20, and a rubber band may be used as the bending parts 60.

In the above-described configuration, the main body 10 and the toe insertion holes 20 may be formed by weaving or knitting and thus have flexibility due to weaving or knitting in addition to flexibility of a fiber itself, and the toe corrective inserts 50, the bending parts 60, and the outsoles 30 may be fixed to the main body 10 by sewing or fixed to the main body 10 using an adhesive unit, such as an adhesive.

When a user wear the above-described non-slip footwear 100, even if the rear part of the sole of a foot of the user first contacts the floor during walking, transmission of impact to the heel of the foot and slipping may be prevented, keratinized tissues are not discharged to the outside by the bending parts 60, the main body 10 repeats compression and expansion and stimulates the foot of the user and the non-slip dots 12 and 32 and the acupressure protrusions 14 also stimulate the foot of the user and thus, circulation of blood in the foot of the user may be improved and the toes of the foot of the user may be corrected by the toe corrective inserts 50.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. Non-slip footwear comprising:

a main body formed of a flexible material and formed to surround the sole of a foot of a user and to open the top side of the foot;

toe insertion holes formed of the flexible material, protruding from the front part of the main body so that toes of the foot are respectively inserted into the toe insertion holes;

an non-slip outsole formed at the heel part of the main body and formed of foamed rubber having abrasion resistance, and having a thickness of 1 mm~5 mm; and non-slip dots formed at the sole part of the main body and the non-slip outsole, wherein toe corrective inserts formed of silicon and having elasticity and shape stability are formed at areas between the toes of the toe insertion holes.

2. Non-slip footwear comprising:

a main body formed of a flexible material and formed to surround the sole of a foot of a user and to open the top side of the foot;

toe insertion holes formed of the flexible material, protruding from the front part of the main body so that toes of the foot are respectively inserted into the toe insertion holes;

an non-slip outsole formed at the heel part of the main body and formed of foamed rubber having abrasion resistance, and having a thickness of 1 mm~5 mm; and non-slip dots formed at the sole part of the main body and the non-slip outsole, wherein the flexible material is a synthetic fiber having flexibility, wherein toe corrective inserts formed of silicon and having elasticity and shape stability are formed at areas between the toes of the toe insertion holes.

3. The non-slip footwear according to claim 1, wherein acupressure protrusions protrude from the inner surface of the main body.

4. Non-slip footwear comprising:

a main body formed of a flexible material and formed to surround the sole of a foot of a user and to open the top side of the foot;

toe insertion holes formed of the flexible material, protruding from the front part of the main body so that toes of the foot are respectively inserted into the toe insertion holes;

an non-slip outsole formed at the heel part of the main body and formed of foamed rubber having abrasion resistance, and having a thickness of 1 mm~5 mm; and non-slip dots formed at the sole part of the main body and the non-slip outsole, wherein the front parts of the toe insertion holes are opened so that the front parts of the toes protrude outward from the non-slip footwear, wherein toe corrective inserts formed of silicon and having elasticity and shape stability are formed at areas between the toes of the toe insertion holes.

5. The non-slip footwear according to claim 1, wherein bending parts having elasticity are formed at the end of the top part of the main body and the ends of the front parts of the toe insertion hole.

6. The non-slip footwear according to claim 2, wherein acupressure protrusions protrude from the inner surface of the main body.

7. The non-slip footwear according to claim 2, wherein the front parts of the toe insertion holes are opened so that the front parts of the toes protrude outward from the non-slip footwear.

8. The non-slip footwear according to claim 2, wherein bending parts having elasticity are formed at the end of the top part of the main body and the ends of the front parts of the toe insertion holes.

* * * * *